US010214863B2

(12) United States Patent
Bednarczyk et al.

(10) Patent No.: US 10,214,863 B2
(45) Date of Patent: Feb. 26, 2019

(54) PLATE ELEMENT FOR A FASTENING POINT AT WHICH A RAIL, WHICH IS PROVIDED FOR RAIL VEHICLES, IS FASTENED AND FASTENING POINT

(71) Applicant: Vossloh-Werke GmbH, Werdohl (DE)

(72) Inventors: Adrian Bednarczyk, Ludenscheid (DE); Igor Dottai, Essen (DE); Martin Gnaczynski, Plettenberg (DE)

(73) Assignee: Vossloh-Werke GmbH, Werdohl (DE)

( * ) Notice: Subject to any disclaimer, the term of this patent is extended or adjusted under 35 U.S.C. 154(b) by 87 days.

(21) Appl. No.: 15/022,780

(22) PCT Filed: Sep. 18, 2014

(86) PCT No.: PCT/EP2014/069908
§ 371 (c)(1),
(2) Date: Mar. 17, 2016

(87) PCT Pub. No.: WO2015/040118
PCT Pub. Date: Mar. 26, 2015

(65) Prior Publication Data

US 2016/0230352 A1 Aug. 11, 2016

(30) Foreign Application Priority Data

Sep. 18, 2013 (DE) ..... 10 2013 110 288

(51) Int. Cl.
*E01B 9/40* (2006.01)
*E01B 9/22* (2006.01)
(Continued)

(52) U.S. Cl.
CPC ..... *E01B 9/22* (2013.01); *E01B 9/02* (2013.01); *E01B 9/40* (2013.01); *E01B 9/42* (2013.01); *E01B 9/48* (2013.01)

(58) Field of Classification Search
CPC ..... E01B 9/02; E01B 9/10; E01B 9/12; E01B 9/22; E01B 9/30; E01B 9/303;
(Continued)

(56) References Cited

U.S. PATENT DOCUMENTS 3,827,631 A * 8/1974 Kirik ..... E01B 9/686 238/283
4,026,466 A * 5/1977 Duchemin ..... E01B 9/28 238/349
(Continued)

FOREIGN PATENT DOCUMENTS

CH 385 262 * 12/1964
CN 102713065 A 10/2012
(Continued)

OTHER PUBLICATIONS

German reference—DE 1 097 470 (English Translation) (Year: 1961).*
(Continued)

*Primary Examiner* — Mark T Le
(74) *Attorney, Agent, or Firm* — The Webb Law Firm

(57) ABSTRACT

A plate element for a fastening point, at which a rail for rail vehicles is fastened to a fixed base. The plate element has an opening leading from the upper side thereof associated with the rail to be fastened to the underside thereof associated with the base, through which a fastening element for fastening the plate element onto the base is guided during use, which engages with an anchor fitting countersunk into the base, and a fastening point at which a rail for a rail vehicle is fastened to a fixed base. The plate element enables the fastening of a rail onto a fixed base, ensuring optimum electrical insulation. This is achieved by a ring element made from a flexibly resilient material sitting in the region of the mouth of the opening associated with the base.

13 Claims, 6 Drawing Sheets

(51) Int. Cl.

| | |
|---|---|
| ***E01B 9/48*** | (2006.01) |
| ***E01B 9/02*** | (2006.01) |
| ***E01B 9/42*** | (2006.01) |

(58) Field of Classification Search
CPC ... E01B 9/306; E01B 9/32; E01B 9/34; E01B 9/38; E01B 9/40; E01B 9/42; E01B 9/46; E01B 9/48; E01B 9/483; E01B 9/486
See application file for complete search history.

(56) References Cited

U.S. PATENT DOCUMENTS

| | | | | |
|---|---|---|---|---|
| 4,191,389 | A * | 3/1980 | Jelinek | F16B 43/001 277/637 |
| 5,096,119 | A | 3/1992 | Schultheiss et al. | |
| 8,840,036 | B2 * | 9/2014 | Bosterling | F16B 13/02 238/377 |
| 2004/0084548 | A1 * | 5/2004 | Schwarzbich | E01B 9/40 238/310 |
| 2012/0298765 | A1 | 11/2012 | Bösterling et al. | |
| 2013/0056545 | A1 | 3/2013 | Danneberg et al. | |

FOREIGN PATENT DOCUMENTS

| | | | |
|---|---|---|---|
| CN | 103038421 | A | 4/2013 |
| CN | 203065902 | U | 7/2013 |
| DE | 1 097 470 | * | 1/1961 |
| DE | 1207413 | | 12/1965 |
| DE | 8706556 | U1 | 8/1987 |
| DE | 9101339 | U1 | 4/1991 |
| DE | 4034032 | A1 | 4/1992 |
| DE | 10148411 | A1 | 4/2003 |
| DE | 202004021473 | U1 | 5/2008 |
| FR | 78981 | E | 10/1962 |
| WO | 2012010269 | A1 | 1/2012 |
| WO | 2014139925 | A1 | 9/2014 |

OTHER PUBLICATIONS

Switzerland reference—CH 385 262 (English Translation) (Year: 1964).*

* cited by examiner

PLATE ELEMENT FOR A FASTENING POINT AT WHICH A RAIL, WHICH IS PROVIDED FOR RAIL VEHICLES, IS FASTENED AND FASTENING POINT

CROSS-REFERENCE TO RELATED APPLICATIONS

This application is the United States national phase of International Application No. PCT/EP2014/069908 filed Sep. 18, 2014, and claims priority to German Patent Application No. 10 2013 110 288.3 filed Sep. 18, 2013, the disclosures of which are hereby incorporated in their entirety by reference.

BACKGROUND OF THE INVENTION

Field of the Invention

The invention relates to a plate element for a fastening point at which a rail, which is provided for rail vehicles, is fastened to a fixed base, wherein the plate element has an opening leading from the upper side thereof associated with the rail which is to be fastened to the underside thereof associated with the base, through which opening a fastening element for fastening the plate element onto the base is guided during use, said fastening element engages with an anchor fitting which is countersunk into the base.

The invention also relates to a fastening point formed using a plate element of the type referred to above at which a rail for rail vehicles is mounted onto a fixed base.

Description of Related Art

Plate elements of the type in question are typically so-called 'guide plates' or 'base plates'.

In rail fastening systems of the type in question, guide plates are used to guide the rail to be fastened in a lateral direction and to absorb and deflect shearing forces which occur when rail vehicles travel over the rail. At the same time, spring elements, so-called 'tensioning clamps' or similar, are generally supported and guided on the guide plates and provide the flexibly resilient retaining force required to hold down the rail to be fastened. The guide plates can be designed as so-called 'angled guide plates' on which a shoulder angled in cross section is configured on the underside associated with the base, which sits in a correspondingly shaped recess in the base in an interlocking manner during use thereby guaranteeing optimum deflection of the stresses on the base that occur during operation.

However, base plates are used in systems for fastening rails for rail vehicles, firstly to hold the other components of the respective fastening system down onto the respective base over a large area. Secondly, said base plates are used to adjust the height at which the rail is held above the respective base. In this manner, deviations in height between two adjacent fastening points that exceed a tolerance range can be offset at the respective fastening point. Two or more base plates or base plates with different thicknesses can be stacked on top of each other and pushed under the respective rail for this purpose.

Base plates also include so-called 'ribbed base plates' on the upper side of which associated with the rail to be fastened two parallel ribs arranged at a distance corresponding to the width of the rail foot are configured, on which the rail to be fastened is guided in a lateral direction during use.

The respective plate element is generally anchored to the fixed base by means of conventional sleeper screws, bolts or nails, which are screwed or driven into a plastic anchor fitting countersunk into the base.

Ideally, the plastic anchor fitting is configured such that the upper edge enclosing its anchor fitting opening is configured substantially flush with the contact surface of the base on which the rail to be fastened and the respective parts of the fastening system are supported. Practical experience shows, however, that an ideal arrangement of this kind cannot guarantee the required reliability in practice. Consequently, there has been a move towards moulding a revolving shoulder in the region of the mouth of the opening of the plate element associated with the base of the plate element. In a ready-assembled fastening point, the respective upper edge of the anchor fitting associated with the plate element reaches into the space created by the shoulder if said edge region protrudes beyond the contact surface of the base, on which the plate element sits during use.

In modern rail tracks, the rails, which are generally made from a conductive steel material, are used for signal transmission or similar. This requires optimum electrical insulation in relation to the base. Practical experiences show here that in spite of costly efforts to separate the rail to be fastened from the base by means of suitable adapters or similar, electrical bridges occur again and again between base and rail and remain in place for long periods.

In the light of the prior art explained above, an object of the invention consists in creating a plate element for a fastening point, at which a rail for a rail vehicle is fastened to a fixed base, wherein optimum electrical insulation is guaranteed even under unfavourable conditions of use. A fastening point provided accordingly is also to be indicated.

SUMMARY OF THE INVENTION

A plate element according to the invention for a system for fastening rails provided for rail vehicles onto a fixed base has an opening leading from the upper side thereof associated with the rail, which is to be fastened, to the underside thereof associated with the base in accordance with the prior art referred to at the beginning, through which opening a fastening element for fastening the plate element onto the base is guided during use which engages with an anchor fitting which is countersunk into the base.

According to the invention, a ring element made from a flexibly resilient material now sits in the region of the mouth of the opening associated with the base.

Thus, according to the invention, the region of the plate element, through which, during use in a fastening point created using a plate element according to the invention, the fastening element used to fasten the plate element onto the base engages, is enclosed by a flexible ring element. Said flexible ring element according to the invention forms a barrier, which prevents the penetration of moisture into the coupling region in which, in a fastening point according to the invention, the base, the anchor fitting countersunk into the base and the plate element meet. In this manner, electrical contact between the base and the fastening element is prevented, even in the event of imprecise alignment of the individual components of a fastening point according to the invention.

Sleeper screws, bolts, wedges, nails or similar, traditionally used for this purpose, can be used as fastening elements in a fastening point according to the invention.

The invention is based on the understanding that in conventional plate elements, which are used for rail fastenings, water or other conductive fluids collect in the region of the opening in the plate element, wherein such moisture originating from the base, which increases in the opening due to the capillary effect, is particularly problematic if a fastening element is tucked into the opening during use and only a thin gap remains between the inner surface defining the opening and the peripheral surface of the fastening element, or reaches into opening from the upper side of the plate element. The penetration of moisture through the opening is prevented by means of the invention as a barrier is created by means of the flexible ring element.

As a result of its own individual elasticity, the ring element provided on the plate element according to the invention rests either on the fastening element screwed or hammered into the anchor fitting or on the anchor fitting itself during use. In this manner, the opening is also protected against the penetration of water if, in a rail fastening system mounted using a plate element according to the invention, the associated anchor fitting is not perfectly aligned in relation to the contact surface of the base on which the rail fastening system is set up.

The ring element provided according to the invention is fastened to the plate element such that it is available at the time of mounting, i.e. does not, like a sealing compound, for example, have to be applied prior to attaching the plate element to the base or to the plate element, but comes with the plate element. In this manner, conceivably easy mounting is possible.

The flexible ring element is applied such that an anchor fitting protruding beyond the base in the respective fastening point presses against the flexible element with its upper edge protruding beyond the base during use thus creating a seal, which prevents an electrical connection between the respective base, into which the anchor fitting is countersunk, and the fastening element, which elastic ring element is tucked into the opening and screwed into the anchor fitting in order to fasten the plate element onto the base.

In order to fulfil its sealing function, a ring element according to the invention is flexible at least in an axial direction parallel to the longitudinal axis of the opening of the plate element or in a circumferential direction, wherein depending on the respective design of the ring element, optimum benefit can be achieved if the ring element is flexible in all spatial directions.

If the ring element is flexibly resilient in a circumferential direction, the sealing of the coupling point at which the anchor fitting, the fastening element, the base and the plate element meet in a fastening point according to the invention, is optimised by the clear width of the ring opening of the ring element being smaller than the clear width of the opening in the region of the mouth in which the ring element sits.

In order to achieve a more secure seal even in the case of anchor fittings the upper edge region of which is arranged below the level of the contact surface of the base, it can be advantageous if the ring element protrudes beyond the underside of the plate element in an unmounted state. Consequently, the ring element is compressed during mounting onto the respective base to the extent that it protrudes beyond the underside of the plate element in an unmounted state with the result that a barrier against the seeping through of moisture is also thus created by the ring element, which then presses against the base in a flexibly resilient manner.

An optimum sealing of the opening against the seeping through of moisture can of course be achieved firstly by the ring element pressing against the fastening element guided through the opening in a flexibly resilient manner during use and secondly, pressing against the base or the upper edge of the respectively assigned anchor fitting also in a flexibly resilient manner.

The ring element provided according to the invention for sealing the opening of the plate element can generally be made of any flexible material which has adequate resistance under the conditions that occur during practical use, and is also sufficiently permanently flexible. Such material includes rubber compounds like those which are used to manufacture sealing rings used in pipeline construction, for example, or similar. The ring element can also be made from a closed pore foam plastic, from EPDM (ethylene propylene diene monomer rubber), PUR (polyurethane), NBR (nitrile butadiene rubber), a thermoplastic elastomer, such as TPE or TPU or similar.

As stated at the beginning, a plate element according to the invention can be a guide plate, which typically has a supporting surface on the face side which rests against the side of foot of the rail to be fastened during use.

A plate element according to the invention can also be a base plate, which is arranged at least in sections under the foot of the rail to be fastened during use. This also includes as likewise already referred to above, ribbed base plates or similar.

Insofar as the ring element in a plate element according to the invention is intended to act against a peripheral surface of the fastening element guided through the opening during use, it may be advantageous in order to increase the reliability of the seal, if the ring element carries a sealing lip on its inner peripheral surface defining its ring opening, which rests tightly against the shaft of the respective fastening element during use.

It goes without saying that the ring element can be configured to be flexible in a circumferential or elevational direction, wherein a combination of these characteristics leads to optimum sealing effect.

It is generally advisable to arrange a flexible element in a manner according to the invention regardless of the geometrical constraints in the respective mouth region of the opening of the plate element.

The mounting of a ring element according to the invention at the location of the plate element associated therewith according to the invention can be simplified if a revolving shoulder is formed in the region of the mouth of the opening in which the ring element sits, against which the ring element is supported.

It may be advantageous here if the ring element sits in the region of the mouth of the opening associated therewith in an interlocking manner.

The fit of the ring element in the mouth of the associated opening can be ensured here if the ring element is held in the region of the mouth of the opening in a force-fit manner. The interlocking or force-fit connection can be configured as a clip, click-on or press-fit connection, for example, as appropriate. Particularly in the case of a click-on connection, this can be configured such that it can be released for replacement of the ring element in the context of maintenance or repair work, for example, and consequently the ring element is replaced by a new element of a similar type and the plate element regains a sealing function that is as good as new.

Alternatively or additionally, it may be advantageous to cement the ring element into the mouth of the opening or to otherwise attach it in a firmly bonded manner. This includes, in the event that the plate is made largely of plastic, the option to injection mould the ring element onto the plate element such that an inseparable, integral bond is formed between the ring element and the plate element.

If the plate element of the type according to the invention is a guide plate, which, in a mounted position, acts with its supporting surface against the side of foot of the rail to be fastened, such a plate element is typically used in a rail fastening point, which is set up on a base typically formed by a concrete sleeper or concrete slab and in addition to the respective plate element, comprises a spring element supported on the plate element, which, with at least one holding arm, generates the flexible retaining force required to hold down the rail to be fastened, an anchor fitting countersunk into the base, which is configured flush with the opening of the plate element, as well as a fastening element, which is guided through the opening of the plate element assigned thereto and screwed into the anchor fitting, in order to brace the spring element and fix the position of the plate element relative to the base, wherein the inner peripheral surface of the ring opening of the flexibly resilient ring element of the plate element rests tightly against the peripheral surface of the fastening means or is pressed in a direction parallel to the longitudinal axis of the opening such that it exerts contact pressure on the base.

If the plate element of the type according to the invention is a base plate, then such a plate element is typically used in a rail fastening point, which is set up on a fixed base, also typically formed by a concrete sleeper or concrete slab, and in addition to the respective plate element, comprises a guide plate supported on the plate element, the supporting surface of which acts on the side of the rail foot of the rail to be fastened and at the same time is located on the plate element in a transverse direction to the rail, a spring element supported on the guide plate, which, with at least one holding arm, generates the flexible retaining force required to hold down the rail to be fastened, an anchor fitting countersunk into the base, which is configured flush with the opening of the plate element, as well as a fastening element, which is guided through the opening of the plate element assigned thereto and screwed into the anchor fitting, in order to brace the spring element and fix the position of the plate element relative to the base, wherein the inner peripheral surface of the ring opening of the flexibly resilient ring element of the plate element rests tightly against the peripheral surface of the fastening means or is pressed in a direction parallel to the longitudinal axis of the opening such that it exerts contact pressure on the base.

If the plate element of the type according to the invention is a ribbed base plate, on the upper side of which at least one rib is configured, on which the foot of the rail to be fastened is guided in a mounted position, such a plate element is typically used in a rail fastening point, which is set up on a base typically formed by a concrete sleeper or concrete slab, and in addition to the respective plate element, comprises a spring element supported on the plate element, which, with at least one holding arm, generates the flexible retaining force required to hold down the rail to be fastened, an anchor fitting countersunk into the base, which is configured flush with the opening of the plate element, as well as a fastening element, which is guided through the opening of the plate element assigned thereto and screwed into the anchor fitting, in order to brace the spring element and fix the position of the plate element relative to the base, wherein the inner peripheral surface of the ring opening of the flexibly resilient ring element of the plate element rests tightly against the peripheral surface of the fastening means or is pressed in a direction parallel to the longitudinal axis of the opening such that it exerts contact pressure on the base.

BRIEF DESCRIPTION OF THE DRAWINGS

The invention is explained in greater detail below using example embodiments. The schematic drawings show the following.

DETAILED DESCRIPTION OF THE INVENTION

Figure 1:
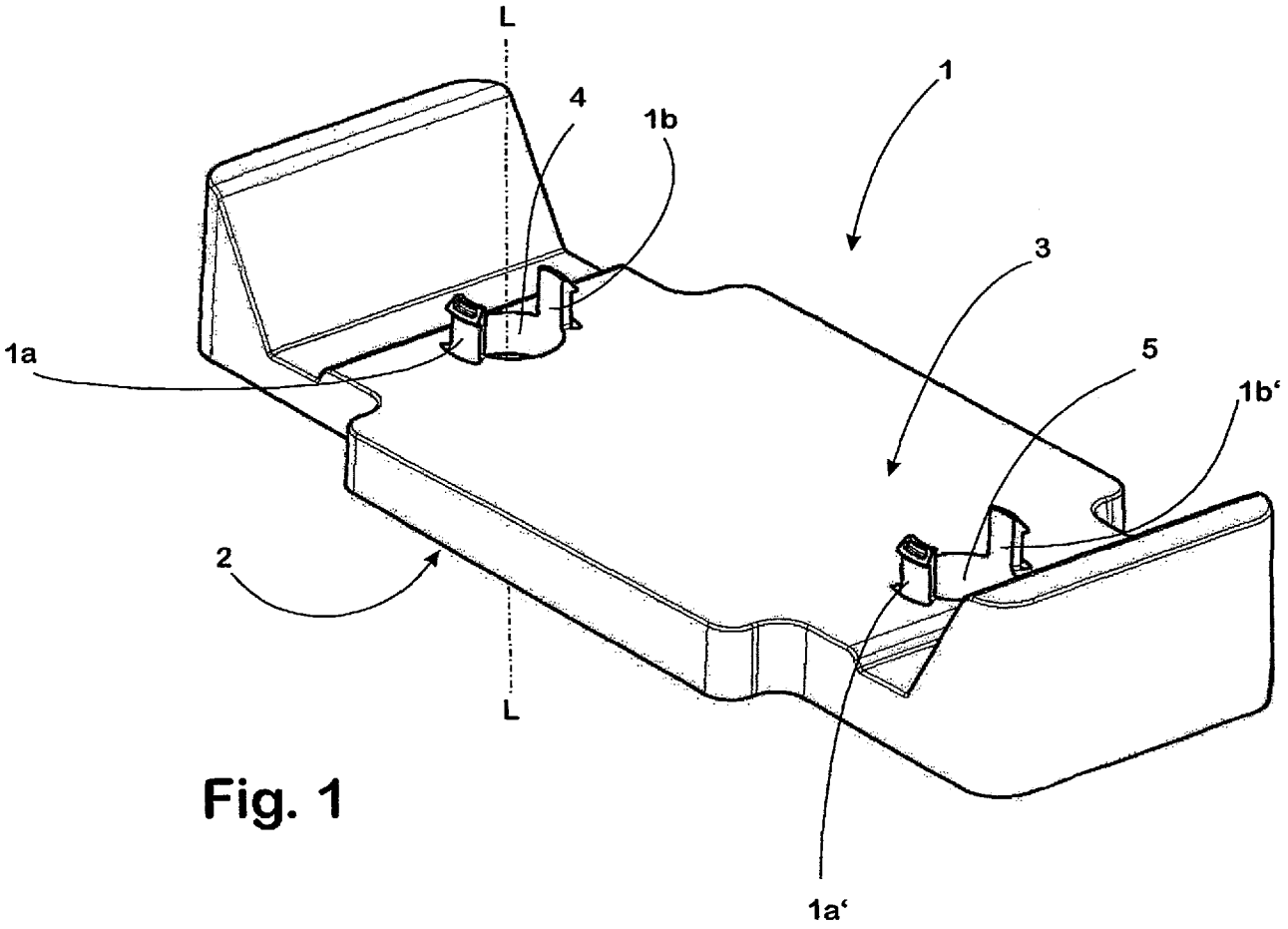
FIG. 1 shows a perspective view of a plate element configured as a base plate.

The plate element 1 designed as a base plate is part of a rail fastening system, as described, for example, in German patent application 10 2013 102 531.5 and in Chinese utility model 201320209968.6 claiming priority over this application. The content of the German patent application and the Chinese utility model is incorporated into the disclosure of the present application for the purposes of additional explanation.

The plate element 1 has a flat underside 2 and an upper side 3 aligned parallel thereto. Two openings 4, 5 are formed in the side end sections of the plate element 1, each of which lead from the upper side 3 to the underside 2. The openings 4, 5 are arranged at a distance such that, in a mounted position, each opening sits to the side of the foot of the rail (not shown here) to be supported on the upper side 3 of the plate element 1.

Figure 2:
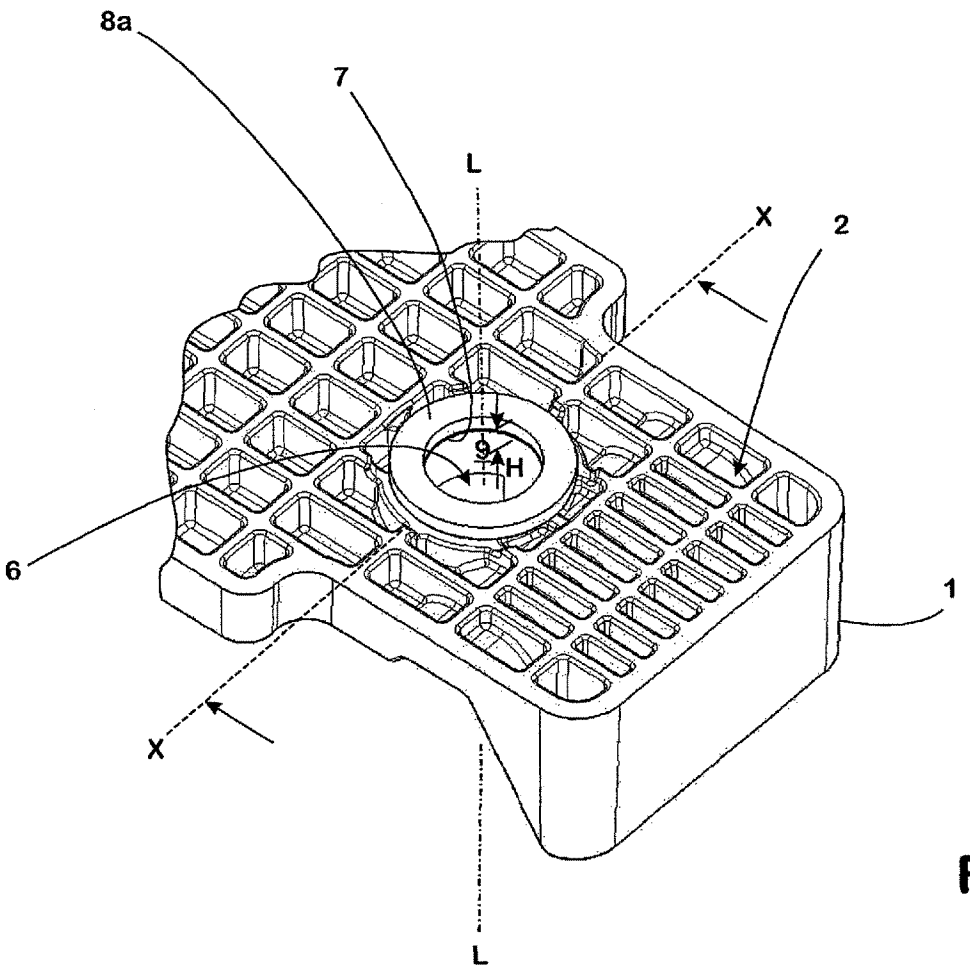
FIG. 2 shows a perspective view of a section of the underside of the plate element according to FIG. 1.
Figure 3:
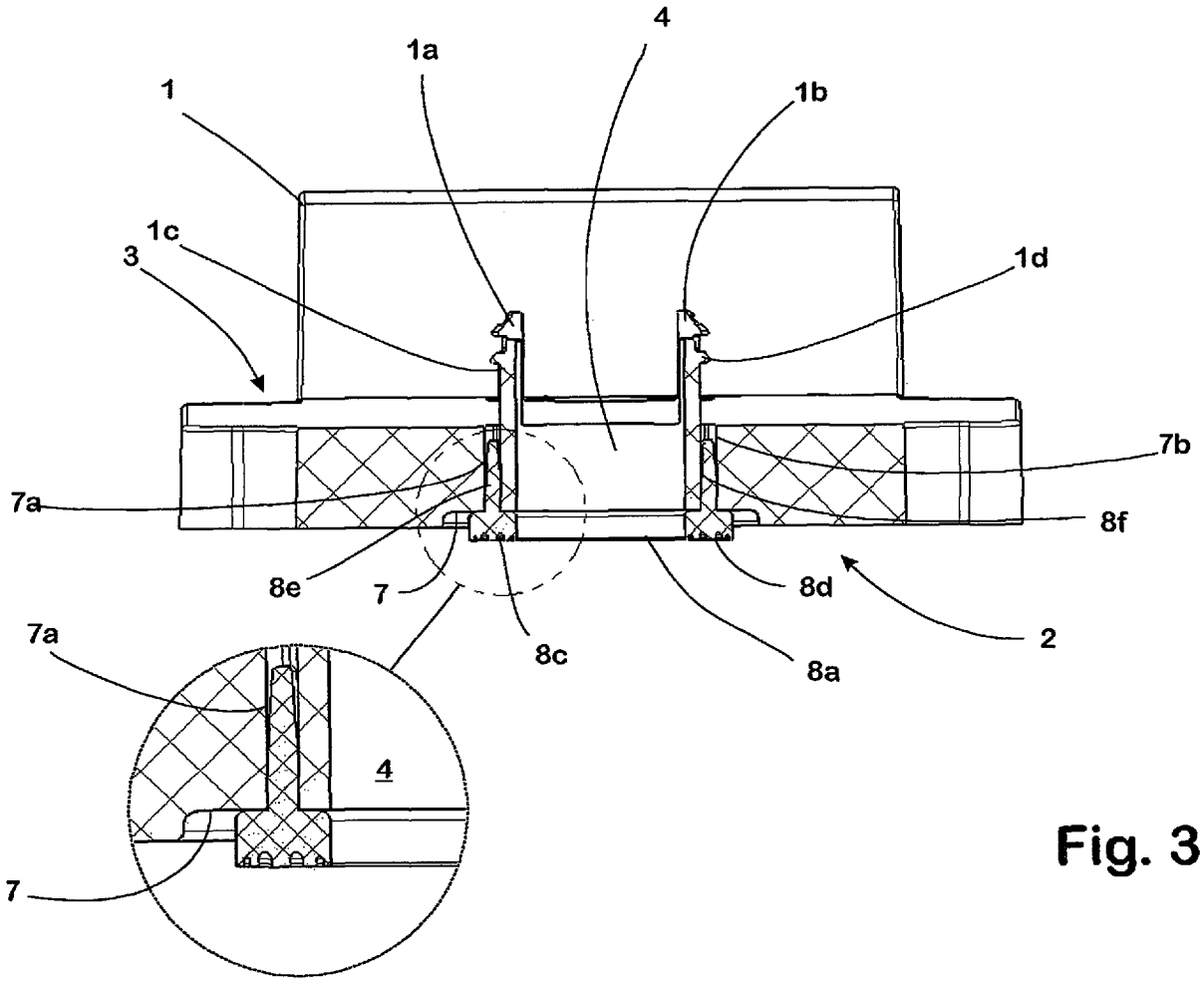
FIG. 3 shows the plate element according to FIG. 1 in a section along the intersecting line X-X drawn in FIG. 2.
Figure 4:
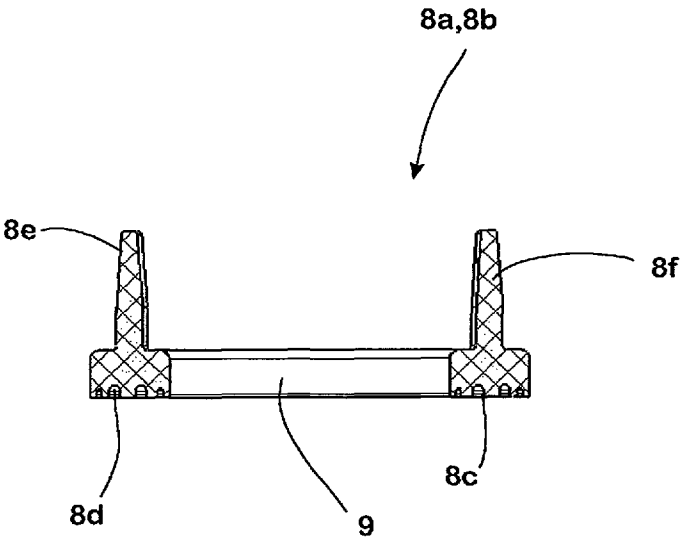
FIG. 4 shows a longitudinal view of a flexible ring element provided for the plate element according to FIG. 1.
Figure 5:
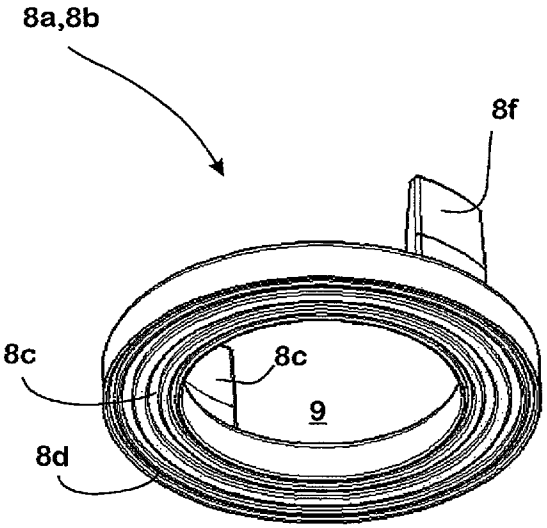
FIG. 5 shows a perspective view of the ring element according to FIG. 4.
Figure 6:
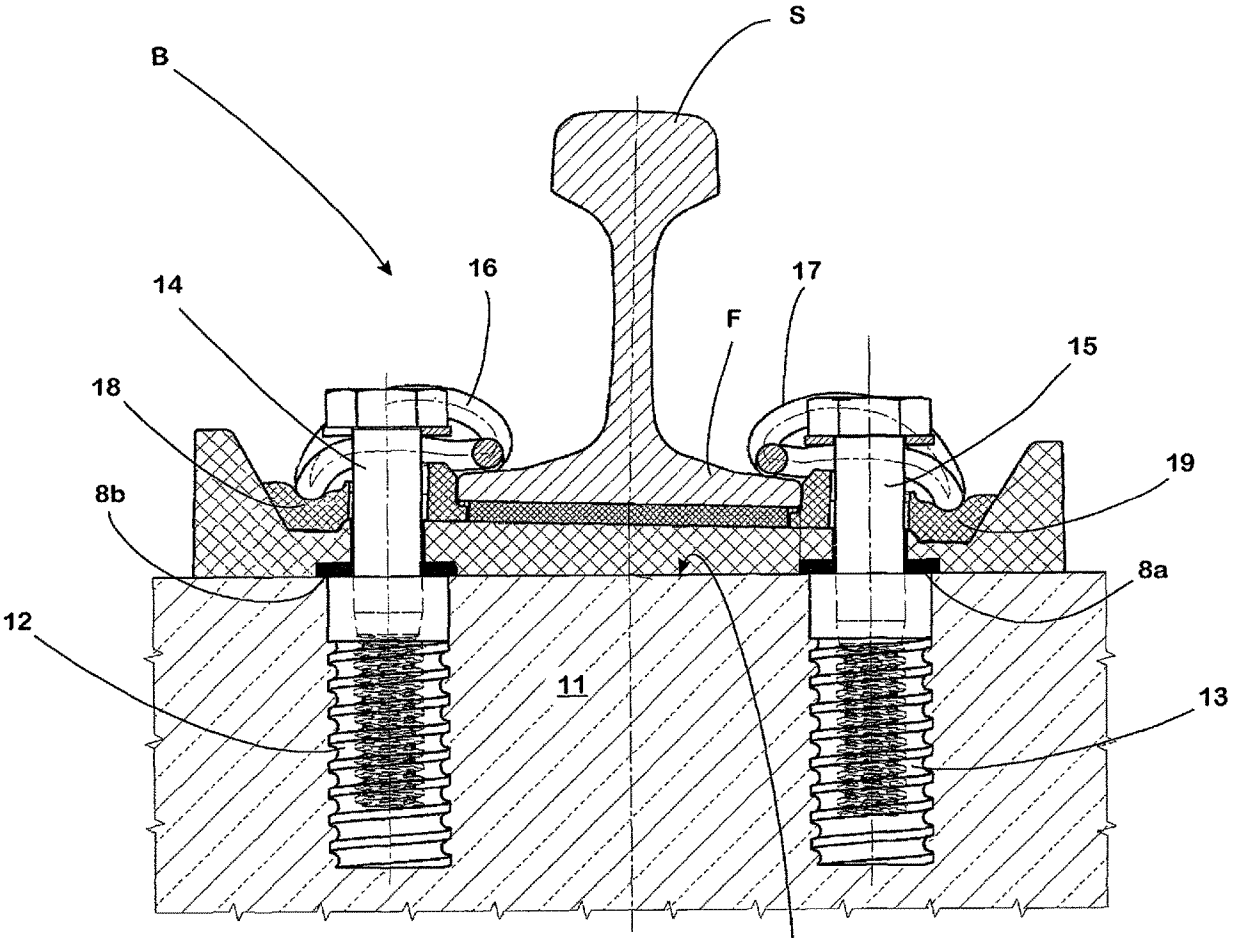
FIG. 6 shows a system for fastening a rail for a rail vehicle to a base using a plate element according to FIG. 1.

As can be seen from FIGS. 2 and 3, a revolving shoulder 7 is formed in the region 6, in which the openings 4, 5, which are circular in cross-section, open onto the underside 2 of the plate element 1. Two slot-shaped channels 7*a*, 7*b* opposite each other are moulded into the base area of the shoulder 7, which channels are arranged at a short distance from the respective opening 4, 5 and extend parallel to the longitudinal axis L of the respective opening 4, 5. The channels 7*a*, 7*b*, form the space for movement for each associated arm 1*a*, 1*b*, 1*a*', 1*b*' moulded onto the plate element 1 in an integral manner and protruding beyond the upper side 3 of the plate element 1, which arm restricts the respective opening 5, 6 in the region of the channels 7*a*, 7*b* and secondly, incorporates catches 1*c*, 1*d* on the free ends thereof.

A ring element 8*a*, 8*b* sits on the shoulder 7. The ring element is made from a rubber-like, flexibly resilient material, for example. The height H of the respective ring element 8*a*, 8*b* measured in the longitudinal direction L of the openings 4, 5 is calculated such that the ring element 8*a*, 8*b* protrudes beyond the underside 2 of the plate element 1 in an unmounted, unstressed state (FIG. 2). In this state, the diameter of the ring opening 9 surrounded by the ring element 8*a*, 8*b* corresponds to the diameter of the respective opening 4, 5.

Two concentrically arranged revolving channels 8*c*, 8*d*, each defined relative to each other and relative to the ring opening 9 and the outer circumferential side by a shoulder, are moulded into the face side 8*c* associated with the underside 2 of the plate element 1, as a result of which the elasticity of the ring elements 8*a*, 8*b* is further enhanced in the region, with which the ring elements 8*a*, 8*b* act relative to the contact surface 10 of a base 11 during use on which the plate element 1 sits during use.

On the side opposite the channels 8*c*, 8*d*, the ring elements 8*a*, 8*b* each have a lug 8*e*, 8*f* the shape of which is adjusted with a slight excess according to the slot-shaped channels 7*a*, 7*b*. For fastening purposes, the lugs 8*e*, 8*f* of the ring elements 8*a*, 8*b* are pressed into the associated channels 7*a*, 7*b* until the respective ring element 8*a*, 8*b* sits on the shoulder 7 assigned thereto. Owing to the individual elasticity of the material of the ring elements 8*a*, 8*b* configured as a single piece, the lugs 8*e*, 8*f* are gently pressed together such that they sit in the respective channel 7*a*, 7*b* in an interlocking and force-fit manner when ready in the opening region 6 of the respective opening 4, 5, and the respective ring element 8*a*, 8*b* is thus held down on the plate element 1.

To mount a fastening point B for a conventional rail S for a rail vehicle, the underside 2 of the plate element 1 is placed onto the contact surface 10 of the fixed base 11 created by a concrete sleeper or concrete slab. Anchor fittings 12, 13 are countersunk into the base 11 and aligned flush with the respectively associated opening 4, 5.

Insofar as the anchor fittings 12, 13 are correctly and accurately aligned such that their upper edges, which define the respective anchor fitting opening, are aligned flush with the contact surface 10 of the base 11, the ring elements 8*a*, 8*b* sit on the edge of the base 11 enclosing the respective anchor fitting 12, 13. If, however, the upper edge of one of the anchor fittings 12, 13 protrudes beyond the contact surface 10, then the respective ring element 8*a*, 8*b* presses against said edge.

Regardless of how the contact occurs, the ring element 8*a*, 8*b* is compressed on mounting due to the dimensioning of its height such that a certain pressure is exerted on the respective counter flange 'edge region of the base 11' or 'upper edge of the respective anchor fitting 12, 13'. This pressure is sufficient to prevent moisture from penetrating the contact region.

Along with the pressing together following contact with the base 11 or the upper edge of an anchor fitting, the flexible material of the ring elements 8*a*, 8*b* makes way in the direction of the respective ring opening 9 such that the ring elements 8*a*, 8*b*, with their inner surfaces enclosing the respective ring opening, press gently against the peripheral surfaces of sleeper screws 14, 15 serving as fastening elements, one of which is pushed into one of the openings 4, 5 and screwed into the respective associated anchor fitting 12, 13 in order to tighten a tensioning clamp 16, 17 and generate the flexible retaining force required to hold it down. In this manner, a double sealing effect is achieved by the ring elements 8*a*, 8*b*.

The tensioning clamps 16, 17 each rest on a guide plate 18, 19, which each sit on a section of the plate element 1 protruding beyond the side of the foot F of the rail S and their face side contact surface associated with the rail foot S rests against the side of the rail foot F. The guide plates 18, 19 each have an opening, which is aligned flush with the associated opening 4, 5 and through which the respective associated fastening element 14, 15 is pushed.

The plate element 1 has already been provided with pre-installed guide plates 18, 19 for mounting. For this purpose, the arms 1*a*, 1*b*, 1*a*', 1*b*' of the plate element 1 reach through the openings of the guide plates 18, 19 associated with them and lock in place with the upper edge of their catch 1*c*, 1*d*, which defines the opening of the respective guide plate 18, 19. In this manner, the guide plates 18, 19 are held in a detachable, interlocking manner on the plate element 1 and can be placed together with said plate element as a unit onto the contact surface 10.

Figure 8:
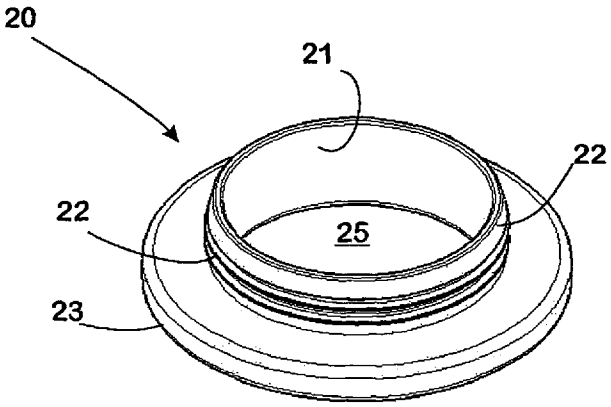
FIG. 8 shows a perspective view of the ring element according to FIG. 7.
Figure 7:
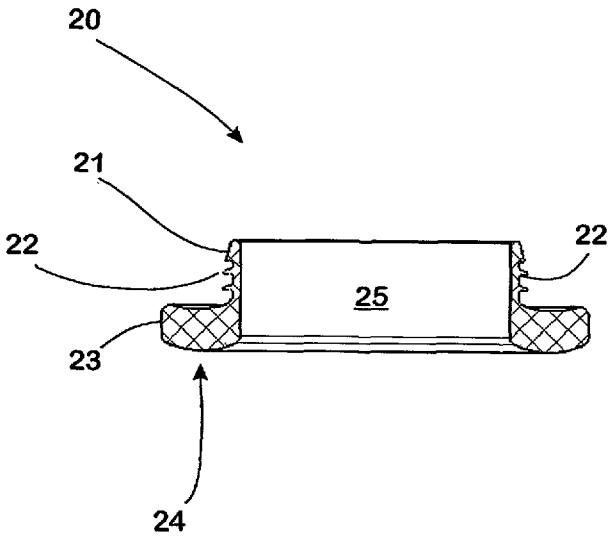
FIG. 7 shows a longitudinal view of an alternative embodiment of a flexible ring element.

FIG. 7 and FIG. 8 show an alternative embodiment of a ring element 20 which can be used instead of the ring elements 8*a*, 8*b*. The ring element 20, manufactured like the ring elements 8*a*, 8*b* as a single piece from a flexibly resilient, electrically non-conductive synthetic material, is configured in the form of a sleeve with a cylindrical sleeve body 21 and has revolving catch-like lugs 22 on its outer peripheral surface. In addition, a revolving rim-like collar 23 is formed on its one face side. The collar 23 is slightly curved such that the free face side 24 thereof protrudes slightly over the edge which defines the mouth of the ring opening 25 of the ring element 20 in the region of the collar 22.

For assembling the sleeve body 21 of a ring element 20 is pushed into one of the openings 4, 5 of the plate element 1 until the collar 23 of the respective ring element 20 sits on the shoulder 7 of the associated opening 4, 5. The lugs 22 are formed so as to be flexible such that the respective ring element 20 is held in an interlocking and, as a result of friction locking, also in a force-fit manner, in the respective opening 4, 5 after being pushed in.

The thickness of the collar 23 and its curvature are selected such that the collar 23 is pressed together flexibly when the plate element 1 is set on the contact surface 23 thus ensuring a more secure seal between the plate element 1 and the base 11 in the region of the mouth 6 of the respective opening 4, 5. At the same time, the inner surface of the ring opening 25 of the ring element 20 rests tightly against the peripheral surface of the fastening element 14, 15 guided through the ring opening 25 in ready-mounted fastening point B, thus creating a further safeguard against the penetration of moisture and the occurrence of electrically conductive bridges.

REFERENCE NUMERALS

| | |
|---|---|
| 1 | Plate element |
| 1a, 1b | Arms |
| 1a', 1b' | Arms |
| 1c, 1d | Catches of the arms 1a, 1b |
| 2 | |
| 7 | Shoulder |
| 8a, 8b | Ring elements |
| 8c, 8d | Channel |
| 9 | Ring opening |
| 10 | Contact surface |
| 11 | Base |
| 12, 13 | Anchoring fitting |
| 14, 15 | Sleeper screws (fastening element) |
| 16, 17 | Tensioning clamps |
| B | Fastening point |
| F | Foot of the rail S |
| H | Height of the respective ring element 8a, 8b |
| S | Rail |

The invention claimed is:

1. A plate element for a fastening point in which a rail provided for rail vehicles is fastened to a base, wherein the plate element comprises an opening leading from an upper side of the plate element associated with the rail to be fastened to an underside of the plate element associated with the base, wherein a fastening element for fastening the plate element onto the base is guided through the opening during use, wherein the fastening element engages with an anchor fitting countersunk into the base, wherein a ring element made from a flexibly resilient material sits in a mouth of the opening associated with the base, such that the ring element is carried by the plate element at a time of mounting the plate element on the base, and wherein a revolving shoulder is moulded into the mouth of the opening in which the ring element sits, on which shoulder the ring element is supported.

2. The plate element according to claim 1, wherein the ring element is designed to be flexible in a circumferential direction.

3. The plate element according to claim 2, wherein the ring element has a ring opening, whose inside diameter is smaller than an inside diameter of the opening in the mouth in which the ring element sits.

4. The plate element according to claim 1, wherein the ring element is flexibly resilient in a direction parallel to a longitudinal axis of the opening.

5. The plate element according to claim 4, wherein the ring element protrudes beyond the underside of the plate element in an unmounted plate element.

6. The plate element according to claim 1, wherein the plate element is a guide plate, which comprises a contact surface on a face side, which rests on a side of a foot of the rail to be fastened during use.

7. The plate element according to claim 1, wherein the plate element is a base plate, which is arranged at least in sections under a foot of the rail to be fastened during use.

8. The plate element according to claim 1, wherein the ring element sits in the mouth of the opening associated therewith in an interlocking manner.

9. The plate element according to claim 1, wherein the ring element is held in the mouth of the opening associated therewith in a force-fit manner.

10. The plate element according to claim 9, wherein the ring element is locked into place with the plate element in a separable manner.

11. The plate element according to claim 1, wherein the plate element is made of a synthetic material and the ring element is firmly bonded to the plate element.

12. The plate element according to claim 11, wherein the ring element is injection moulded onto the plate element.

13. A fastening point at which a rail for a rail vehicle is fastened to a fixed base, comprising a plate element configured according to claim 1, an anchor fitting countersunk into the base, and a fastening element guided through an opening of the plate element and screwed into the anchor fitting in order to fasten the plate element to the base.

* * * * *